US011746661B2

(12) United States Patent
Kim et al.

(10) Patent No.: US 11,746,661 B2
(45) Date of Patent: Sep. 5, 2023

(54) TURBINE BLADE AND TURBINE INCLUDING THE SAME

(71) Applicants: DOOSAN ENERBILITY CO., LTD., Changwon-si (KR); INDUSTRY-ACADEMIC COOPERATION FOUNDATION, YONSEI UNIVERSITY, Seoul (KR)

(72) Inventors: Ye Jee Kim, Suwon (KR); Hyung Hee Cho, Seoul (KR); Minjoo Hyun, Seoul (KR); Hee Seung Park, Seoul (KR); Seungyeong Choi, Seoul (KR); Taehyun Kim, Seoul (KR)

( * ) Notice: Subject to any disclaimer, the term of this patent is extended or adjusted under 35 U.S.C. 154(b) by 0 days.

(21) Appl. No.: 17/846,077

(22) Filed: Jun. 22, 2022

(65) Prior Publication Data

US 2022/0412217 A1 Dec. 29, 2022

(30) Foreign Application Priority Data

Jun. 24, 2021 (KR) ..... 10-2021-0082484
Sep. 28, 2021 (KR) ..... 10-2021-0128309

(51) Int. Cl.
*F01D 5/18* (2006.01)
*F01D 25/12* (2006.01)

(52) U.S. Cl.
CPC ..... *F01D 5/18* (2013.01); *F01D 25/12* (2013.01)

(58) Field of Classification Search
CPC ..... F01D 5/18; F01D 25/12
USPC ..... 415/177
See application file for complete search history.

(56) References Cited

U.S. PATENT DOCUMENTS 4,424,001 A * 1/1984 North ..... F01D 5/20 415/173.5
4,684,323 A * 8/1987 Field ..... F01D 5/186 415/115
4,738,588 A * 4/1988 Field ..... F01D 5/186 415/115
5,062,768 A * 11/1991 Marriage ..... F01D 5/186 29/889.721
5,096,379 A * 3/1992 Stroud ..... F01D 5/186 29/889.721

(Continued)

FOREIGN PATENT DOCUMENTS

JP 2013124612 A 6/2013
KR 20070120187 A 12/2007

(Continued)

OTHER PUBLICATIONS

EESR, dated Aug. 17, 2022.
The JP Office Action, dated Apr. 25, 2023.

*Primary Examiner* — Logan M Kraft
*Assistant Examiner* — John D Bailey
(74) *Attorney, Agent, or Firm* — Harvest IP Law, LLP

(57) ABSTRACT

A turbine blade having cooling holes formed therein and a turbine including the same are provided. The turbine blade includes an airfoil having a leading edge and a trailing edge formed thereon and a cooling passage defined for flow of a cooling fluid therethrough, and a cooling hole configured to communicate between the cooling passage and outside in the airfoil and having an inlet and an outlet, wherein the cooling hole includes an expanded portion and a grooved portion formed in the outlet, the grooved portion being recessed from the expanded portion toward the trailing edge.

16 Claims, 9 Drawing Sheets

(56) References Cited

U.S. PATENT DOCUMENTS 5,609,779 A * 3/1997 Crow ..... B23K 26/0622 219/121.78
5,651,662 A * 7/1997 Lee ..... F01D 5/186 60/757
5,660,525 A * 8/1997 Lee ..... F01D 5/186 60/757
6,287,075 B1 * 9/2001 Kercher ..... F01D 5/186 415/115
6,979,176 B2 * 12/2005 Nakamata ..... F01D 5/186 416/97 R
7,186,085 B2 * 3/2007 Lee ..... F01D 5/186 416/97 R
7,273,351 B2 * 9/2007 Kopmels ..... F01D 5/186 416/97 R
7,374,401 B2 * 5/2008 Lee ..... F01D 5/186 415/115
7,520,715 B2 * 4/2009 Durocher ..... F01D 9/04 415/176
7,621,718 B1 * 11/2009 Liang ..... F01D 25/12 415/115
7,766,609 B1 * 8/2010 Liang ..... F01D 25/08 415/138
7,887,294 B1 * 2/2011 Liang ..... F01D 5/186 416/97 R
7,997,868 B1 * 8/2011 Liang ..... F01D 5/186 416/97 R
8,057,181 B1 * 11/2011 Liang ..... F01D 5/186 416/97 R
8,245,519 B1 * 8/2012 Liang ..... F01D 5/186 415/115
8,628,292 B2 * 1/2014 Maltson ..... F01D 5/188 415/115
8,683,813 B2 * 4/2014 Xu ..... F01D 9/065 415/115
8,790,083 B1 * 7/2014 Liang ..... F01D 5/186 416/97 R
8,850,828 B2 * 10/2014 Mongillo, Jr. ..... F01D 9/065 415/115
8,858,175 B2 * 10/2014 Dutta ..... F01D 5/186 416/97 R
9,441,488 B1 * 9/2016 Johnson ..... F01D 5/186
9,696,035 B2 * 7/2017 Starkweather ..... B23K 26/384
10,215,030 B2 * 2/2019 Xu ..... F01D 11/08
10,233,775 B2 * 3/2019 Bunker ..... F01D 5/186
10,669,858 B2 * 6/2020 Mozharov ..... F01D 5/187
11,021,965 B2 * 6/2021 Crites ..... F02C 7/18
11,459,898 B2 * 10/2022 Mongillo, Jr. ..... F23R 3/002
2005/0286998 A1 * 12/2005 Lee ..... B23K 26/384 415/117
2008/0003096 A1 * 1/2008 Kohli ..... F01D 5/186 415/115
2008/0031738 A1 * 2/2008 Lee ..... F01D 5/186 416/97 R
2008/0057271 A1 * 3/2008 Bunker ..... F01D 5/186 428/137
2008/0286090 A1 * 11/2008 Okita ..... F01D 9/023 415/115
2009/0074588 A1 * 3/2009 Scott ..... F01D 5/186 415/115
2009/0304499 A1 * 12/2009 Strock ..... F23R 3/002 415/175
2010/0068032 A1 * 3/2010 Liang ..... F01D 5/186 415/115
2010/0282721 A1 * 11/2010 Bunker ..... F01D 25/285 219/121.61
2011/0097191 A1 * 4/2011 Bunker ..... F01D 5/186 415/115
2011/0123312 A1 * 5/2011 Venkataramanan .... F01D 5/186 415/115
2011/0132876 A1 * 6/2011 Pietraszkiewicz ..... F01D 5/186 83/30
2011/0185572 A1 * 8/2011 Wei ..... B23K 26/389 29/418
2011/0293423 A1 * 12/2011 Bunker ..... F01D 5/186 29/889
2011/0311369 A1 * 12/2011 Ramachandran ..... F01D 5/186 416/97 R
2012/0051941 A1 * 3/2012 Bunker ..... F01D 5/186 416/97 R
2012/0167389 A1 * 7/2012 Lacy ..... F01D 5/186 29/889.1
2013/0115103 A1 * 5/2013 Dutta ..... F01D 5/186 29/889.7
2013/0205791 A1 * 8/2013 Mongillo, Jr. ..... F01D 5/186 60/806
2013/0205801 A1 * 8/2013 Xu ..... F01D 9/065 29/889.22
2013/0209236 A1 * 8/2013 Xu ..... F01D 9/041 415/116
2013/0209269 A1 * 8/2013 Gleiner ..... F01D 5/187 29/888.012
2013/0243575 A1 * 9/2013 Zelesky ..... F01D 25/12 415/116
2013/0259645 A1 * 10/2013 Bergholz, Jr. ..... F01D 5/18 415/115
2013/0259705 A1 * 10/2013 Bergholz, Jr. ..... F01D 5/186 416/97 R
2013/0302177 A1 * 11/2013 Bergholz, Jr. ..... F01D 5/187 416/97 R
2014/0099189 A1 * 4/2014 Morris ..... F01D 5/186 415/115
2014/0271229 A1 * 9/2014 Nita ..... F01D 5/186 416/97 R
2016/0024937 A1 * 1/2016 Xu ..... F01D 9/065 416/95
2016/0047251 A1 * 2/2016 Xu ..... F01D 5/189 416/97 R
2017/0002685 A1 * 1/2017 Todorovic ..... F01D 9/02
2017/0081959 A1 * 3/2017 Lewis ..... F02C 7/18
2017/0152750 A1 * 6/2017 Xu ..... F23R 3/06
2019/0085705 A1 * 3/2019 Webster ..... F01D 25/12
2019/0186277 A1 * 6/2019 Spangler ..... F01D 9/023
2020/0300096 A1 * 9/2020 Lee ..... F01D 5/186
2020/0370436 A1 * 11/2020 Vogel ..... B33Y 80/00

FOREIGN PATENT DOCUMENTS

KR 20120115006 A 10/2012
KR 20170020008 A 2/2017
KR 20180021553 A 3/2018
KR 20180021657 A 3/2018
KR 20190037775 A 4/2019
KR 20190042866 A 4/2019
KR 20190122918 A 10/2019
KR 20200055978 A 5/2020
KR 20210071906 A 6/2021

* cited by examiner

TURBINE BLADE AND TURBINE INCLUDING THE SAME

CROSS-REFERENCE TO RELATED APPLICATIONS

This application claims priority to Korean Patent Application Nos. 10-2021-0082484, filed on Jun. 24, 2021, and 10-2021-0128309, filed on Sep. 28, 2021, the disclosures of which are incorporated herein by reference in their entireties.

BACKGROUND

Technical Field

Apparatuses and methods consistent with exemplary embodiments relate to a turbine blade and a turbine including the same, and more particularly, to a turbine blade having cooling holes formed therein and a turbine including the same.

Description of the Related Art

A gas turbine is a power engine that mixes air compressed by a compressor with fuel for combustion and rotates a turbine with hot gas produced by the combustion. The gas turbine is used to drive a generator, an aircraft, a ship, a train, or the like.

The gas turbine includes a compressor, a combustor, and a turbine. The compressor sucks and compresses outside air, and transmits the compressed air to the combustor. The compressed air compressed by the compressor has a high-pressure and high-temperature. The combustor mixes the compressed air supplied from the compressor with fuel and combusts a mixture of compressed air and fuel to produce combustion gas. The combustion gas produced by the combustion is discharged to the turbine. Turbine blades in the turbine are rotated by the combustion gas to generate power. The generated power is used in various fields such as generating electric power and actuating machines.

Recently, in order to increase the efficiency of the turbine, the temperature of the gas flowing into the turbine (which is also referred to as "turbine inlet temperature (TIT)") has been continuously increasing, and thus, the importance of heat-resistant treatment and cooling of the turbine blades is being emphasized.

Examples of a method of cooling turbine blades include a film cooling method. The film cooling method is performed by film cooling holes formed in turbine blades. Examples of the film cooling holes include a circular hole having the same inlet and outlet area. In the case of the circular hole, the high injection rate at the outlet of the hole may prevent a cooling fluid from covering the surface of each turbine blade. In this case, the cooling fluid may break through the flow of combustion gas, thereby reducing the efficiency of film cooling.

SUMMARY

Aspects of one or more exemplary embodiments provide a turbine blade with improved cooling efficiency and a turbine including the same.

Additional aspects will be set forth in part in the description which follows and, in part, will become apparent from the description, or may be learned by practice of the exemplary embodiments.

According to an aspect of an exemplary embodiment, there is provided a turbine blade including: an airfoil having a leading edge and a trailing edge formed thereon and a cooling passage defined for flow of a cooling fluid therethrough, and a cooling hole configured to communicate between the cooling passage and outside in the airfoil and having an inlet and an outlet. The cooling hole may include an expanded portion and a grooved portion formed in the outlet, the grooved portion being recessed from the expanded portion toward the trailing edge.

The cooling hole may be configured to have a larger cross-sectional area at the outlet than at the inlet.

The cooling hole may further include a curved portion having a constant radius of curvature, the curved portion being formed at a boundary between the expanded portion and the grooved portion.

The expanded portion may have a substantially quadrangular shape.

The grooved portion may have a substantially quadrangular shape.

When a direction parallel to a straight line connecting the leading edge and the trailing edge is a first direction, the expanded portion may be formed to constantly maintain a 1-1th width, which is a width in the first direction, in at least some sections.

The 1-1th width may be less than or equal to an inner diameter of the inlet.

When a rotational radial direction of the turbine blade is a second direction, the expanded portion may be formed such that a 1-2nd width, which is a width in the second direction, is 4 times or more of an inner diameter of the inlet.

The grooved portion may be configured such that the width in the second direction is a 2-2nd width, and the 1-2nd width may be larger than a sum of the inner diameter of the inlet and the 2-2nd width.

The grooved portion may include a first grooved portion and a second grooved portion, the first grooved portion may be recessed from the expanded portion toward the trailing edge, and the second grooved portion may be recessed from the first grooved portion toward the trailing edge.

When a rotational radial direction of the turbine blade is a second direction, the grooved portion may be configured to have a 2-2nd width, which is a width in the second direction. The curved portion may include two curved portions spaced apart from each other, and a center distance between the two curved portions may be larger than the 2-2nd width.

According to an aspect of another exemplary embodiment, there is provided a turbine including: a turbine rotor disk configured to be rotatable, a plurality of turbine blades disposed on the turbine rotor disk, and a plurality of turbine vanes. Each of the turbine blades may include an airfoil having a leading edge and a trailing edge formed thereon and a cooling passage defined for flow of a cooling fluid therethrough, and a cooling hole configured to communicate between the cooling passage and outside in the airfoil and having an inlet and an outlet. The cooling hole may include an expanded portion and a grooved portion formed in the outlet, the grooved portion being recessed from the expanded portion toward the trailing edge.

The cooling hole may further include a curved portion having a constant radius of curvature, the curved portion being formed at a boundary between the expanded portion and the grooved portion.

The expanded portion may have a substantially quadrangular shape.

The grooved portion may have a substantially quadrangular shape.

When a direction parallel to a straight line connecting the leading edge and the trailing edge is a first direction, the expanded portion may be formed to constantly maintain a 1-1th width, which is a width in the first direction, in at least some sections.

The 1-1th width may be less than or equal to an inner diameter of the inlet.

When a rotational radial direction of the turbine blade is a second direction, the expanded portion may be formed such that a 1-2nd width, which is a width in the second direction, is larger than an inner diameter of the inlet.

The grooved portion may be configured such that the width in the second direction is a 2-2nd width, and the 1-2nd width may be larger than a sum of the inner diameter of the inlet and the 2-2nd width.

When a rotational radial direction of the turbine blade is a second direction, the grooved portion may be configured to have a 2-2nd width, which is a width in the second direction. The curved portion may include two curved portions spaced apart from each other, and a center distance between the two curved portions may be larger than the 2-2nd width.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
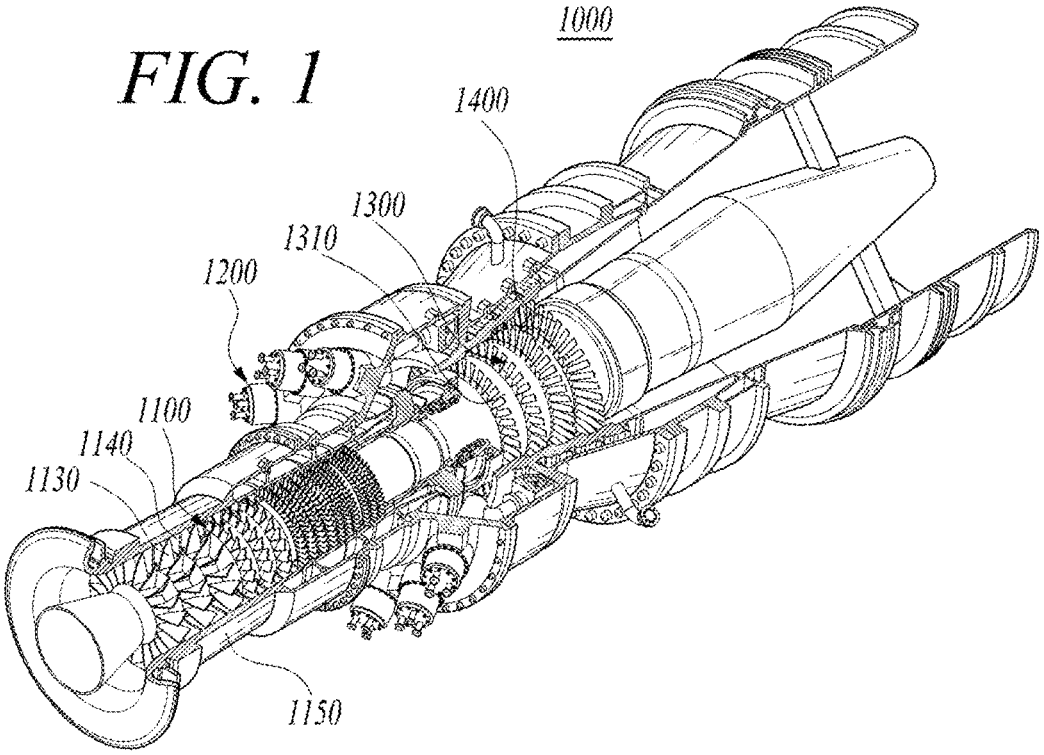
FIG. 1 is a perspective view illustrating an interior of a gas turbine according to an exemplary embodiment.

Various modifications and various embodiments will be described below in detail with reference to the accompanying drawings so that those skilled in the art can easily carry out the disclosure. It should be understood, however, that the various embodiments are not for limiting the scope of the disclosure to the specific embodiments, but they should be interpreted to include all modifications, equivalents or alternatives of the embodiments included within the spirit and scope disclosed herein.

The terminology used herein is for the purpose of describing specific embodiments only and is not intended to limit the scope of the disclosure. As used herein, the singular forms "a", "an" and "the" are intended to include the plural forms as well, unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Exemplary embodiments will be described below in detail with reference to the accompanying drawings. It should be noted that like reference numerals refer to like parts throughout different drawings and exemplary embodiments. In certain embodiments, a detailed description of functions and configurations well known in the art may be omitted to avoid obscuring appreciation of the disclosure by those skilled in the art. For the same reason, some components may be exaggerated, omitted, or schematically illustrated in the accompanying drawings.

Hereinafter, a turbine blade and a turbine including the same according to exemplary embodiments will be described in detail with reference to the accompanying drawings.

Figure 2:
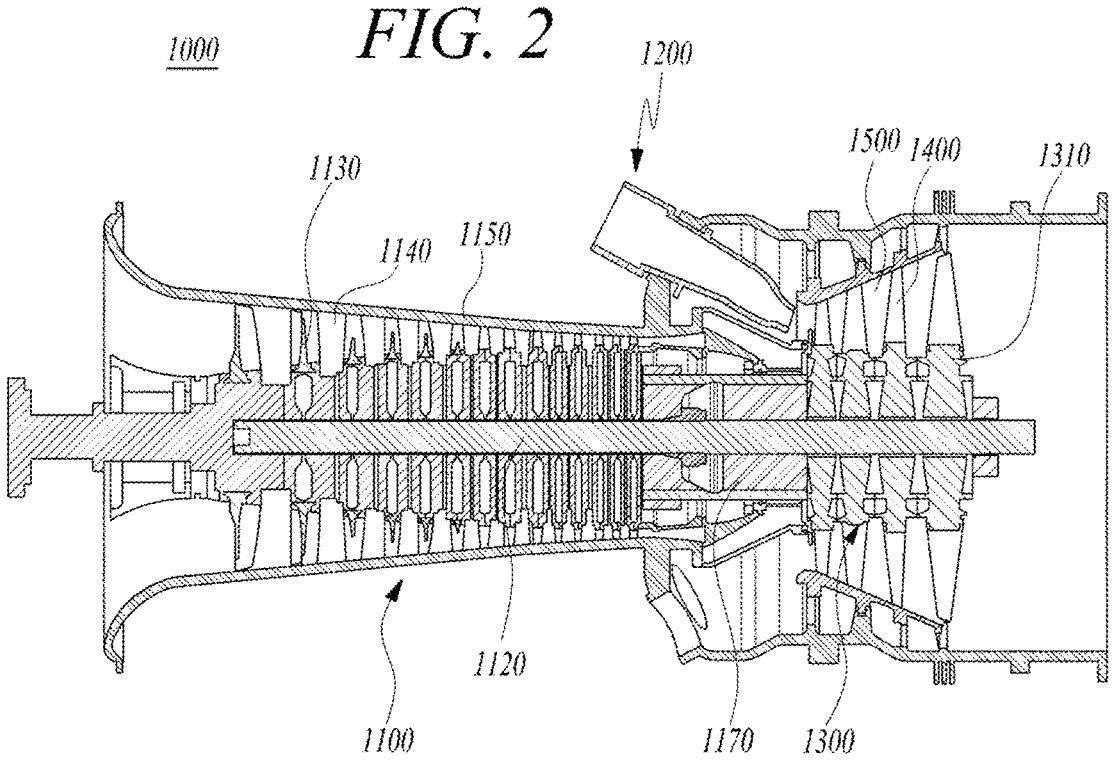
FIG. 2 is a partial cross-sectional view illustrating the gas turbine of FIG. 1.
Figure 3:
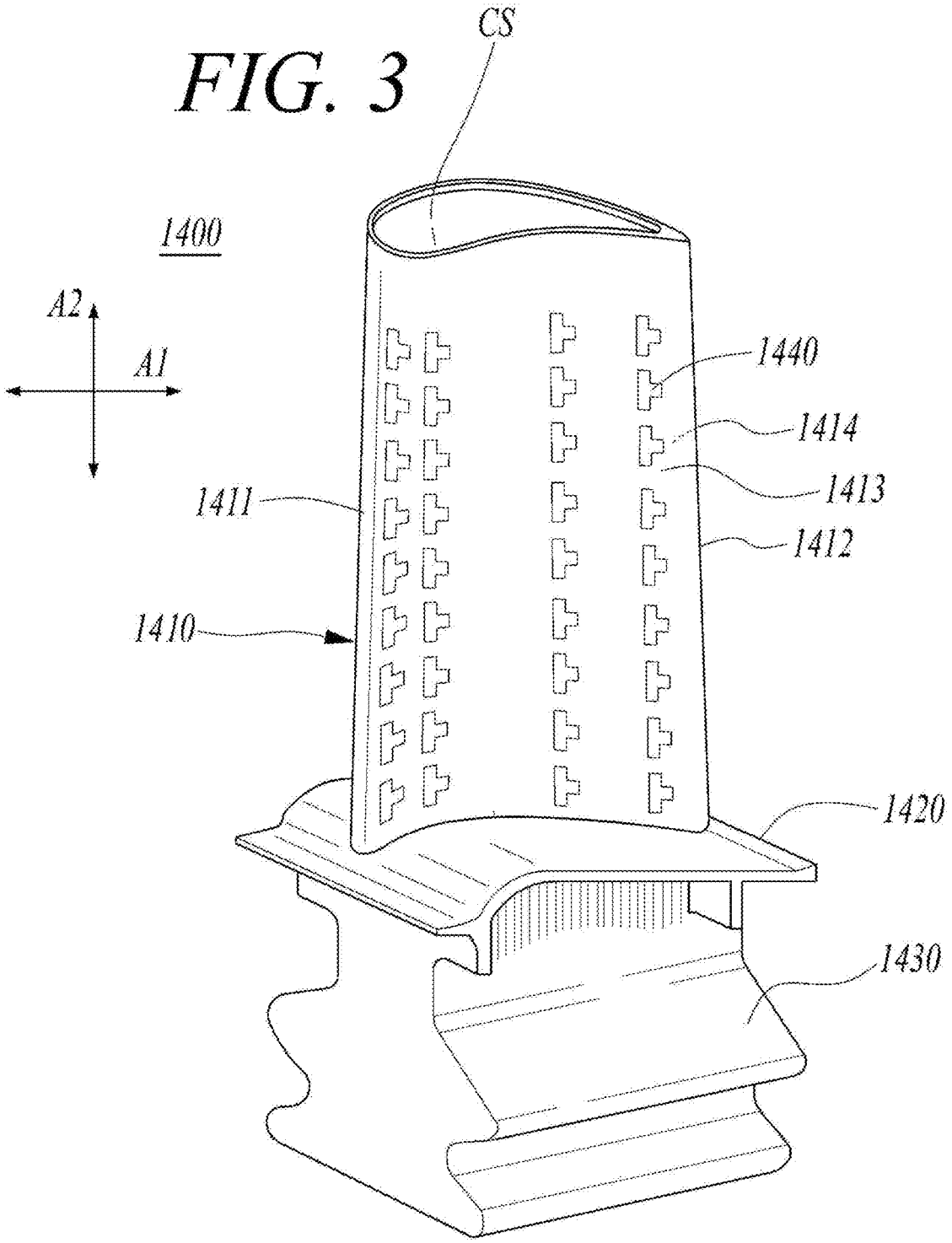
FIG. 3 is a view illustrating one turbine blade according to the exemplary embodiment.
Figure 4:
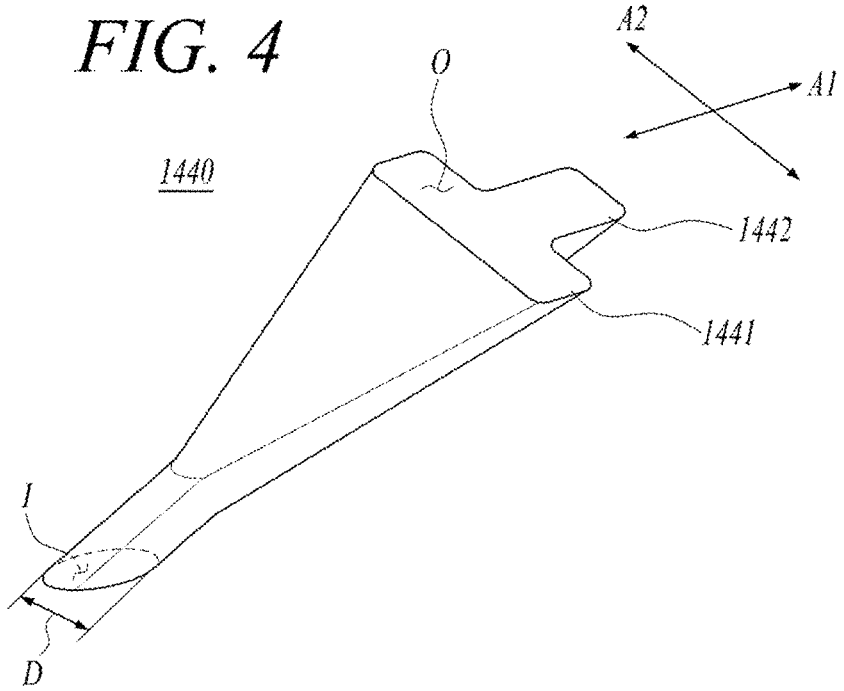
FIG. 4 is a view illustrating one cooling hole according to the exemplary embodiment.
Figure 5:
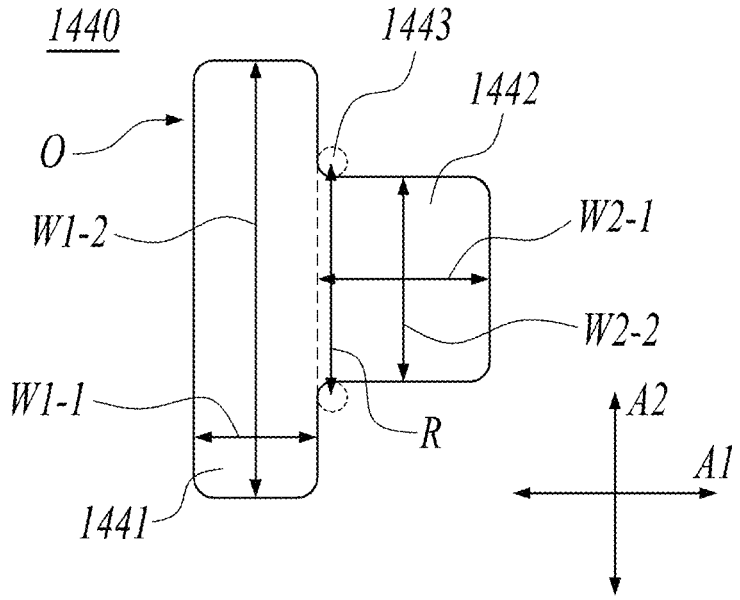
FIG. 5 is a view illustrating an outlet of the cooling hole of FIG. 4.
Figure 6A:
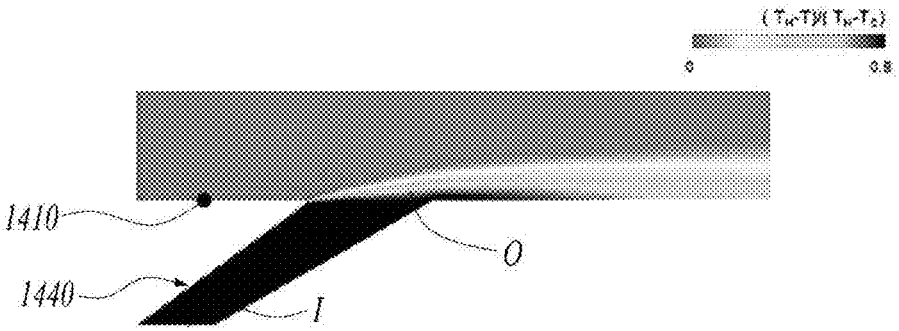
FIG. 6A (Related Art)
FIGS. 6A and 6B are diagrams illustrating a flow of cooling fluid discharged from the cooling hole according to the exemplary embodiment compared with that of a related art.
Figure 6B:
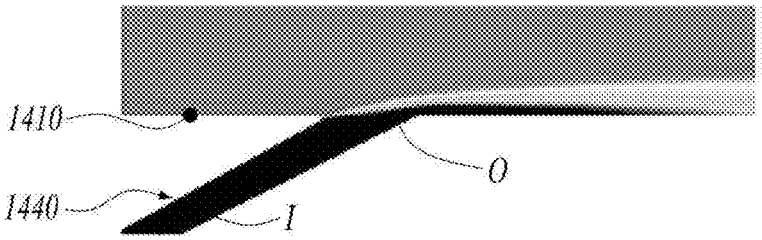

FIG. 1 is a perspective view illustrating an interior of a gas turbine according to an exemplary embodiment. FIG. 2 is a partial cross-sectional view illustrating the gas turbine of FIG. 1. FIG. 3 is a view illustrating one turbine blade according to the exemplary embodiment. FIG. 4 is a view illustrating one cooling hole according to the exemplary embodiment. FIG. 5 is a view illustrating an outlet of the cooling hole of FIG. 4. FIGS. 6A and 6B are diagrams illustrating a flow of cooling fluid discharged from the cooling hole according to the exemplary embodiment compared with that of a related art.

The thermodynamic cycle of a gas turbine 1000 may comply with a Brayton cycle. The Brayton cycle may consist of four phases including an isentropic compression (i.e., an adiabatic compression), an isobaric heat addition, an isentropic expansion (i.e., an adiabatic expansion), and an isobaric heat dissipation. In other words, in the Brayton cycle, thermal energy may be released by combustion of fuel in an isobaric environment after the atmospheric air is sucked and compressed into a high pressure air, hot combustion gas may be expanded to be converted into kinetic energy, and exhaust gas with residual energy may be discharged to the atmosphere. As such, the Brayton cycle may consist of four thermodynamic processes including compression, heating, expansion, and exhaust.

The gas turbine 1000 employing the Brayton cycle may include a compressor 1100, a combustor 1200, and a turbine 1300. Although the following description is given with reference to FIG. 1, the present disclosure may be widely applied to a turbine engine having the same configuration as the gas turbine 1000 exemplarily illustrated in FIG. 1.

Referring to FIGS. 1 and 2, the compressor 1100 of the gas turbine 1000 may suck air from the outside and compress the air. The compressor 1100 may supply the compressed air compressed by compressor blades 1130 to the combustor 1200, and may supply cooling air to a high temperature region required for cooling in the gas turbine 1000. In this case, because the air sucked into the compressor 1100 is subject to an adiabatic compression process therein, the pressure and temperature of the air passing through the compressor 1100 increase.

The compressor 1100 may be designed in a form of a centrifugal compressor or an axial compressor, and the centrifugal compressor is applied to a small-scale gas turbine, whereas the multistage axial compressor 1100 is applied to the large-scale gas turbine 1000 illustrated in FIG. 1 to compress a large amount of air. In the multistage axial compressor 1100, the compressor blades 1130 rotate along with a rotation of rotor disks together with a center tie rod 1120 to compress air introduced thereinto while delivering the compressed air to compressor vanes 1140 disposed at a following stage. The air is compressed increasingly to a high pressure while passing through the compressor blades 1130 formed in a multistage manner.

A plurality of compressor vanes 1140 may be formed in a multistage manner and mounted in a compressor casing 1150. The compressor vanes 1140 guide the compressed air moved from compressor blades 1130 disposed at a preceding stage to compressor blades 1130 disposed at a following stage. For example, at least some compressor vanes 1140 may be mounted so as to be rotatable within a predetermined range for regulating the inflow rate of air.

The compressor 1100 may be driven using a portion of the power output from the turbine 1300. To this end, a rotary shaft of the compressor 1100 may be directly connected to a rotary shaft of the turbine 1300 by a torque tube 1170. In the case of large-scale gas turbine 1000, almost half of the power generated by the turbine 1300 may be consumed to drive the compressor 1100.

The combustor 1200 may mix the compressed air supplied from an outlet of the compressor 1100 with fuel and combust the air-fuel mixture at a constant pressure to produce combustion gas with high energy. That is, the combustor 1200 mixes fuel with the inflowing compressed air and burns the mixture to produce high-temperature and high-pressure combustion gas with high energy, and increases the temperature of the combustion gas to a heat-resistant limit of combustor and turbine components through an isobaric combustion process.

A plurality of combustors constituting the combustor 1200 may be arranged in a form of a shell in a housing. Each combustor 1200 includes a plurality of burners having a fuel injection nozzle, a combustor liner defining a combustion chamber, and a transition piece serving as a connection between the combustor and the turbine.

The high-temperature and high-pressure combustion gas discharged from the combustor 1200 is supplied to the turbine 1300. The supplied high-temperature and high-pressure combustion gas applies impingement or reaction force to turbine blades 1400 while expanding to generate rotational torque. A portion of the rotational torque is transmitted to the compressor 1100 via the torque tube 1170, and the remaining portion which is the excessive torque is used to drive a generator, or the like.

The turbine 1300 includes a plurality of rotor disks 1310, a plurality of turbine blades 1400 radially arranged on each of the rotor disks 1310, and a plurality of turbine vanes 1500. Each of the rotor disks 1310 has a substantially disk shape and has a plurality of grooves formed on an outer peripheral surface thereof. The grooves are formed to have a curved surface so that the turbine blades 1400 are inserted into the grooves. The turbine blades 1400 may be coupled to the rotor disk 1310 in a dovetail coupling manner. The turbine vanes 1500 fixed to the housing are provided between the turbine blades 1400 to guide a flow direction of the combustion gas passing through the turbine blades 1400.

Hereinafter, the turbine blades 1400 and the turbine 1300 including the same according to the exemplary embodiment will be described in more detail with reference to FIGS. 3 to 5. Each turbine blade 1400 according to the exemplary embodiment includes an airfoil 1410 and a cooling hole 1440.

Referring to FIGS. 3 to 5, the turbine blade 1400 includes an airfoil 1410 and a cooling hole 1440. The airfoil 1410 may have a wing shape in cross-section and may extend in a radial direction. Combustion gas may pass through the airfoil 1410. The airfoil 1410 may have a leading edge 1411 disposed on an upstream side and a trailing edge 1412 disposed on a downstream side based on a flow direction of combustion gas. In addition, a pressure side 1413 having a curved surface depressed in a concave shape is formed on a rear side of the airfoil 1410, and a suction side 1414 protruding outward to have an outward-convex curved surface is formed on a front side of the airfoil 1410 onto which combustion gas is introduced. The pressure side 1413 and the suction side 1414 may be formed between the leading edge 1411 and the trailing edge 1412. A difference in pressure occurs between the pressure side 1413 and the suction side 1414 of the airfoil 1410, and the turbine blade 1400 may rotate.

The turbine blade 1400 may include a platform 1420 and a root 1430. The platform 1420 may be disposed at the radially inner end of the airfoil 1410 and have a substantially rectangular plate or rectangular pillar shape. The platform 1420 may support the airfoil 1410. The platform 1420 may have a side surface which is in contact with a side surface of a platform of an adjacent turbine blade 1400 to maintain a gap between the adjacent turbine blades 1400.

The root 1430 disposed radially inside the platform 1420 is fixedly coupled to each rotor disk 1310. The root 1430 may include a plurality of roots radially disposed on each rotor disk 1310. Accordingly, when the rotor disk 1310 rotates, the roots 1430 may rotate as well. Each root 1430 may be in a fir-tree shape or dovetail shape.

The airfoil 1410 has a cooling passage CS defined therein so that a cooling fluid flows therethrough. The cooling fluid may be air compressed by the compressor 1100. The cooling passage CS may sequentially pass through the root 1430 and the platform 1420 to reach the airfoil 1410. In this case, the cooling fluid may be introduced into the airfoil 1410 through the root 1430.

The airfoil 1410 has a plurality of cooling holes 1440 formed therein to allow communication between the cooling passage CS and the outside. The cooling hole 1440 may be formed in a sidewall of the airfoil 1410 and include an inlet I and an outlet O. The inlet I of the cooling hole 1440 may have a circular shape with an inner diameter of D. The cooling hole 1440 may have a tubular shape having the inner diameter D in a predetermined section from the inlet I toward the outlet O. The cooling hole 1440 may include a section in which a longitudinal cross-sectional area of the cooling hole 1440 is expanded to the outlet O after the predetermined section having the inner diameter D. The cross-sectional area of the outlet O may be larger than that of the inlet I. In this case, the flow rate of the cooling fluid is reduced at the outlet O to allow more cooling fluid to adhere to the surface of the turbine blade 1400, thereby reducing the occurrence of kidney vortices.

The cooling hole 1440 may be entirely inclined with respect to the surface of the airfoil 1410. For example, the cooling hole 1440 may be inclined towards the trailing edge 1412 from the inlet I to the outlet O.

Here, a direction parallel to the axis of rotation of the turbine blade 1400 or a direction parallel to a straight line connecting the leading edge 1411 and the trailing edge 1412 is defined as a first direction A1, and a direction perpendicular to the first direction A1 is defined as a second direction A2.

The outlet O of the cooling hole 1440 may include an expanded portion 1441 and a grooved portion 1442. The expanded portion 1441 may have a substantially quadrangular shape. The expanded portion 1441 may have an angled quadrangle or a quadrangle with curved vertices. The expanded portion 1441 may have a substantially rectangular shape, and in some cases may have a parallelogram or trapezoidal shape. The expanded portion 1441 may have an optimized shape according to the operating condition and environment of the turbine blade 1400.

The expanded portion 1441 may be formed to constantly maintain a 1-1th width W1-1, which is a width in the first direction A1, in at least some sections. The expanded portion 1441 may extend in the second direction A2 while constantly maintaining the 1-1th width W1-1 in at least some sections. The expanded portion 1441 may have a quadrangular shape having the 1-1th width W1-1 and a 1-2nd width W1-2 which is a width in the second direction A2. The 1-1th width W1-1 of the expanded portion 1441 may be smaller than or equal to the inner diameter D of the inlet. In the section of the expanded portion 1441 in which the 1-1th width W1-1 is constant, the cooling fluid may be discharged in a uniform amount at each point in the second direction A2.

The grooved portion 1442 may be recessed from the trailing-edge-side edge of the expanded portion 1441. The grooved portion 1442 may be recessed toward the trailing edge 1412. The grooved portion 1442 may have an end that is sharply recessed from the expanded portion 1441 toward the trailing edge 1412, and the end may be rounded and curved. The grooved portion 1442 may have a substantially quadrangular shape. In this case, the grooved portion 1442 may have a quadrangular shape having a 2-1th width W2-1 which is a width in the first direction A1, and a 2-2nd width W2-2 which is a width in the second direction A2. The grooved portion 1442 may have an optimized shape according to the operating condition and environment of the turbine blade 1400.

A curved portion 1443 may be formed at a boundary between the expanded portion 1441 and the grooved portion 1442. That is, the curved portion 1443 may be formed at a corner in which the expanded portion 1441 meets the grooved portion 1442. The curved portion 1443 may have a curved shape with a constant radius of curvature, and a center of curvature may be disposed outside the outlet O of the cooling hole 1440. The curved portion 1443 may include two curved portions 1443 spaced apart from each other. The two curved portions 1443 may have a distance R between the respective centers of curvature, which is referred to as a center distance R. The curved portions 1443 may prevent a vortex from occurring in the expanded portion 1441 and the grooved portion 1442 for smooth discharge of the cooling fluid.

A flow in the cooling hole 1440 according to the exemplary embodiment will be described in more detail with reference to FIGS. 6A and 6B. FIGS. 6A and 6B illustrate a difference between the related art and the exemplary embodiment in terms of the side cross-section of the cooling hole 1440 through which the cooling fluid flows. FIGS. 6A and 6B illustrate a temperature distribution. The temperature distribution may be expressed as a parameter of (TH-T)/(TH-Tc), when the temperature of the fluid is T, the temperature of the combustion gas inlet flow is TH, and the temperature of the outlet flow of the cooling fluid is Tc.

The flow of the cooling fluid discharged from the grooved portion 1442 may be adhered longer from the surface of the airfoil 1410 toward the trailing edge 1412 compared to the flow of the cooling fluid discharged from the expanded portion 1441. Therefore, the cooling fluid discharged from the grooved portion 1442 may guide the flow of the cooling fluid discharged from the expanded portion 1441 toward the trailing edge 1412. Accordingly, it can be seen that the flow of the cooling fluid is further expanded while closely adhering to the surface of the airfoil 1410 (FIG. 6B) compared to the related art (FIG. 6A).

Figure 7:
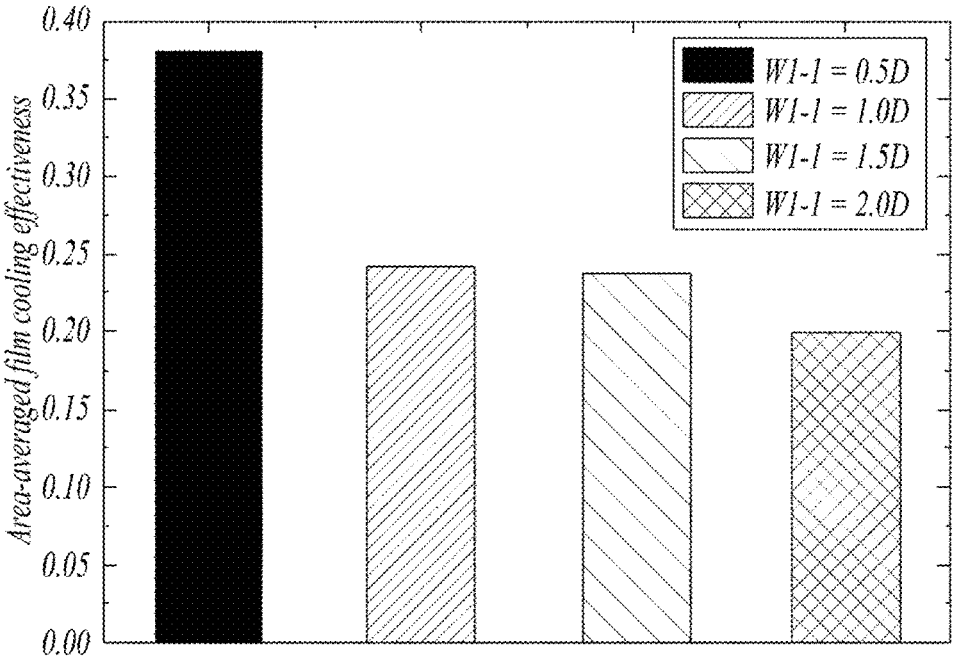
FIG. 7 is a graph illustrating a comparison of cooling effectiveness by the size of a 1-1th width.
Figure 8:
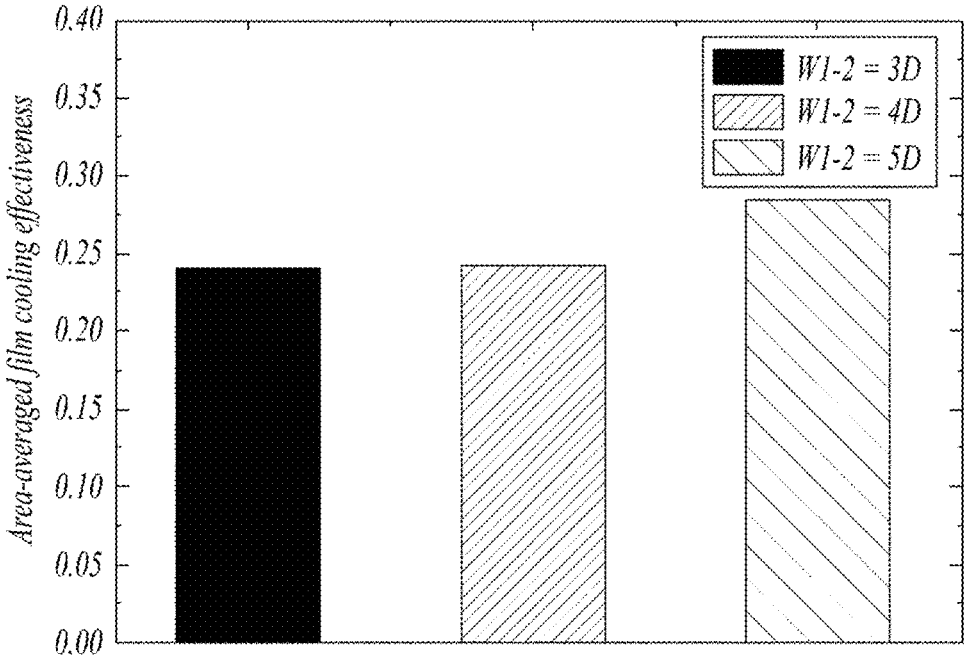
FIG. 8 is a graph illustrating a comparison of cooling effectiveness by the size of a 1-2nd width.
Figure 9:
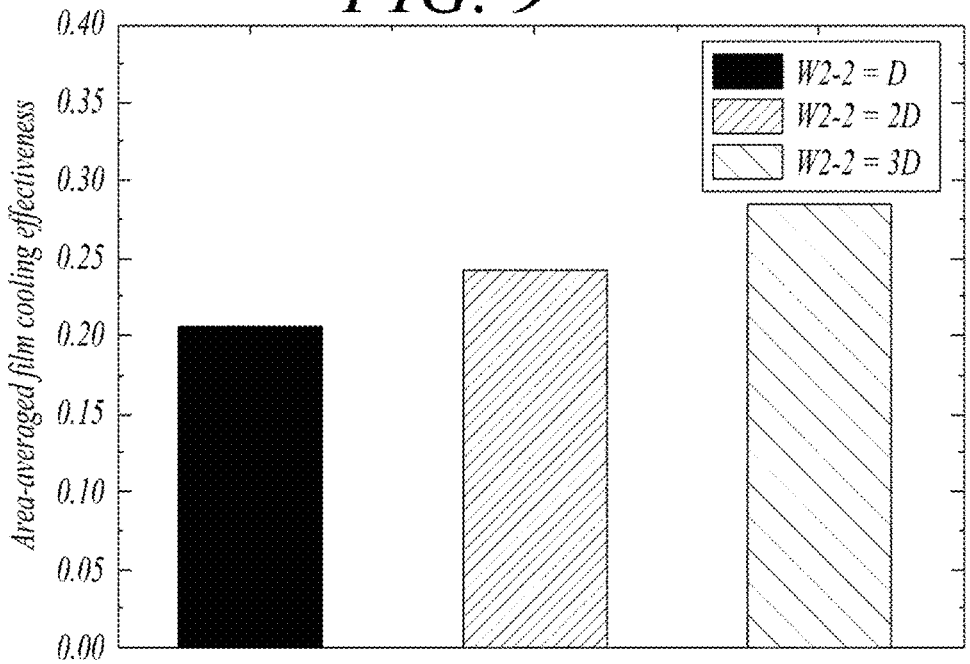
FIG. 9 is a graph illustrating a comparison of cooling effectiveness by the size of a 2-2nd width.
Figure 10:
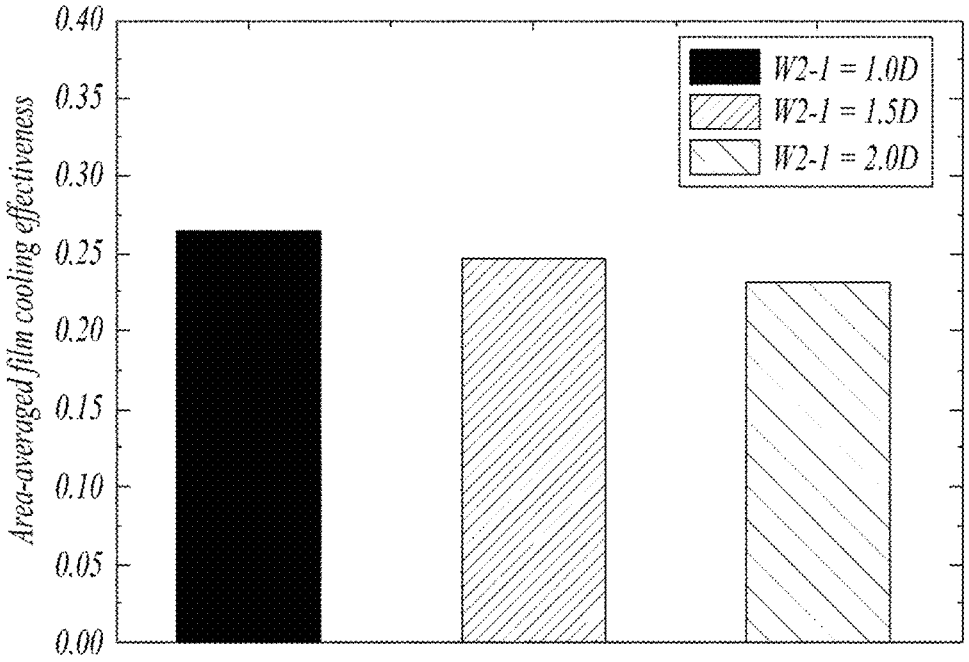
FIG. 10 is a graph illustrating a comparison of cooling effectiveness by the size of a 2-1th width.
Figure 11:
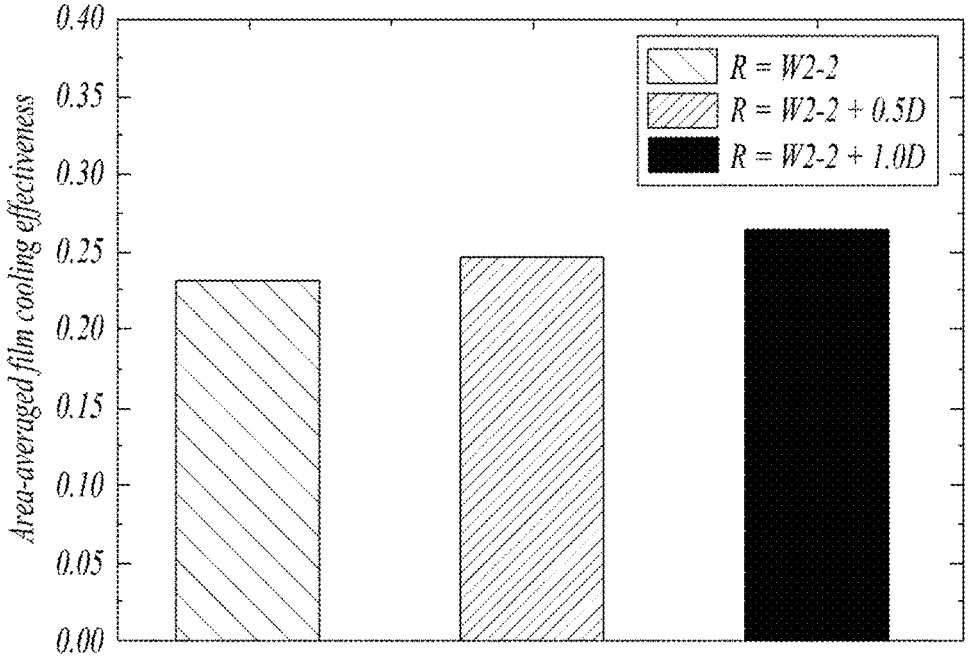
FIG. 11 is a graph illustrating a comparison of cooling effectiveness by the center distance between curved portions.

FIG. 7 is a graph illustrating a comparison of cooling effectiveness by a size of the 1-1th width. FIG. 8 is a graph illustrating a comparison of cooling effectiveness by a size of the 1-2nd width. FIG. 9 is a graph illustrating a comparison of cooling effectiveness by a size of the 2-2nd width. FIG. 10 is a graph illustrating a comparison of cooling effectiveness by a size of the 2-1th width. FIG. 11 is a graph illustrating a comparison of cooling effectiveness by a center distance between the curved portions.

Hereinafter, the cooling hole 1440 according to the exemplary embodiment and the cooling efficiency of the turbine blade 1400 according to the shape of the cooling hole 1440 will be described in detail with reference to FIGS. 7 to 11.

The graphs below are exemplified under the condition that a blowing ratio (also referred to as "BR") is 2. The blowing ratio BR is defined as a ratio of the mass flow rate of cooling fluid per unit area in the cooling hole 1440 to the mass flow rate of combustion gas per unit area in the turbine blade 1400. That is, if the flow velocity and density of the combustion gas in the turbine blade 1400 are VH and DH, respectively, and the flow velocity and density of the cooling fluid in the cooling hole 1440 are Vc and Dc, respectively, the blowing ratio BR is defined as (Vc*Dc)/(VH*DH).

The area-averaged film cooling effectiveness shown in the following graphs is defined as (T-TH)/(Tc-TH). Here, TH is the inlet temperature of the combustion gas flow, Tc is the outlet temperature of the cooling fluid flow, and T is the adiabatic wall surface temperature.

FIG. 7 illustrates a comparison of cooling effectiveness according to the change in the 1-1th width W1-1 when the inlet inner diameter D, the 1-2nd width W1-2, the 2-1th width W2-1, and the 2-2nd width W2-2 are constant. If the 1-1th width W1-1 is larger than the inlet inner diameter D, the cooling effectiveness was measured to be less than 0.25. On the other hand, when the 1-1th width W1-1 is half of the inlet inner diameter D, the cooling effectiveness was measured to be close to 0.4. That is, it can be seen that, the cooling effectiveness is maximized when the 1-1th width W1-1 is less than or equal to the inlet inner diameter D. This may be due to the interaction of the flow of the cooling fluid in the expanded portion 1441 and the flow of the cooling fluid in the grooved portion 1442.

FIG. 8 illustrates a comparison of cooling effectiveness according to the change in the 1-2nd width W1-2 when the inlet inner diameter D, the 1-1th width W1-1, the 2-1th width W2-1, and the 2-2nd width W2-2 are constant. When the 1-2nd width W1-2 is 3 or 4 times the inlet inner diameter D, the cooling effectiveness was measured to be less than 0.25. On the other hand, when the 1-2nd width W1-2 is 5 times the inlet inner diameter D, the cooling effectiveness was measured to be close to 0.30. Accordingly, it can be seen that, the cooling effectiveness increases when the 1-2nd width W1-2 is greater than 4 times the inlet inner diameter D.

For example, it was measured that the cooling effectiveness is maximized when the 1-2nd width W1-2 is greater than 4.5 times the inlet inner diameter D and smaller than 5.95. This may be due to the interaction of the flow of the cooling fluid in the expanded portion 1441 and the flow of the cooling fluid in the grooved portion 1442.

FIG. 9 illustrates a comparison of cooling effectiveness according to the change in the 2-2nd width W2-2 when the inlet inner diameter D, the 1-1th width W1-1, the 1-2nd width W1-2, and the 2-1th width W2-1 are constant. When the 2-2nd width W2-2 is equal to the inlet inner diameter D, the cooling effectiveness was measured to be close to 0.20, and when the 2-2nd width W2-2 is twice the inlet inner diameter D, the cooling effectiveness was measured to be less than 0.25. On the other hand, when the 2-2nd width W2-2 is 3 times the inlet inner diameter D, the cooling effectiveness was measured to be close to 0.30.

For example, the cooling effectiveness was maximized when the length of the 1-2nd width W1-2 is greater than the sum of the 2-2nd width W2-2 and the inlet inner diameter D. However, when the length of the 1-2nd width W1-2 is equal to or greater than the sum of the 2-2nd width W2-2 and twice the inlet inner diameter D, the cooling effectiveness did not increase. This may be due to the interaction of the flow of the cooling fluid in the expanded portion 1441 and the flow of the cooling fluid in the grooved portion 1442.

FIG. 10 illustrates a comparison of cooling effectiveness according to the change in the 2-1th width W2-1 when the inlet inner diameter D, the 1-1th width W1-1, the 1-2nd width W1-2, and the 2-2nd width W2-2 are constant. When the 2-1th width W2-1 is 1.5 or 2.0 times the inlet inner diameter D, the cooling effectiveness was measured to be less than 0.25. On the other hand, when the 2-1th width W2-1 is equal to the inlet inner diameter D, the cooling effectiveness was measured to be higher than 0.25. Accordingly, it can be seen that the cooling effectiveness is maximized when the 2-1th width W2-1 is less than 1.5 times the inlet inner diameter D.

This may be due to the interaction of the flow of the cooling fluid in the expanded portion 1441 and the flow of the cooling fluid in the grooved portion 1442. However, when the curved portions 1443 are formed at the outlet O of the cooling hole 1440, the 2-1th width W2-1 may be larger than 0.5 times the inlet inner diameter D in consideration of the radii of curvature of the curved portions 1443.

FIG. 11 illustrates a comparison of cooling effectiveness according to the change in the distance between the curved portions 1443 when the 1-2nd width W1-2 is 4 times the inlet inner diameter D, the 2-2nd width W2-2 is twice the inlet inner diameter D, the 1-1th width W1-1 is equal to the inlet inner diameter D, and the 2-1th width W2-1 is 1.5 times the inlet inner diameter D. The distance R between the curved portions 1443 refers to a center distance R, which is a distance between centers of curvature of each of the two curved portions 1443. When the size of the center distance R is equal to the 2-2nd width W2-2, the cooling effectiveness was measured to be less than 0.25. When the size of the center distance R is equal to the sum of the 2-2nd width W2-2 and 0.5 times the inlet inner diameter D, the cooling effectiveness was measured to be close to 0.25. When the center distance R is equal to the sum of the 2-2nd width W2-2 and the inlet inner diameter D, the cooling effectiveness was measured to be higher than 0.25.

That is, the curved portions 1443 may have a higher cooling effectiveness than a case in which the curved portion is not formed. It can be seen that the cooling effectiveness is high when the center distance R between the curved portions 1443 is equal to the sum of the 2-2nd width W2-2 and the inlet inner diameter D. This may be because the curved portions 1443 prevent vortexes from occurring in the expanded portion 1441 and the grooved portion 1442.

Figure 12:
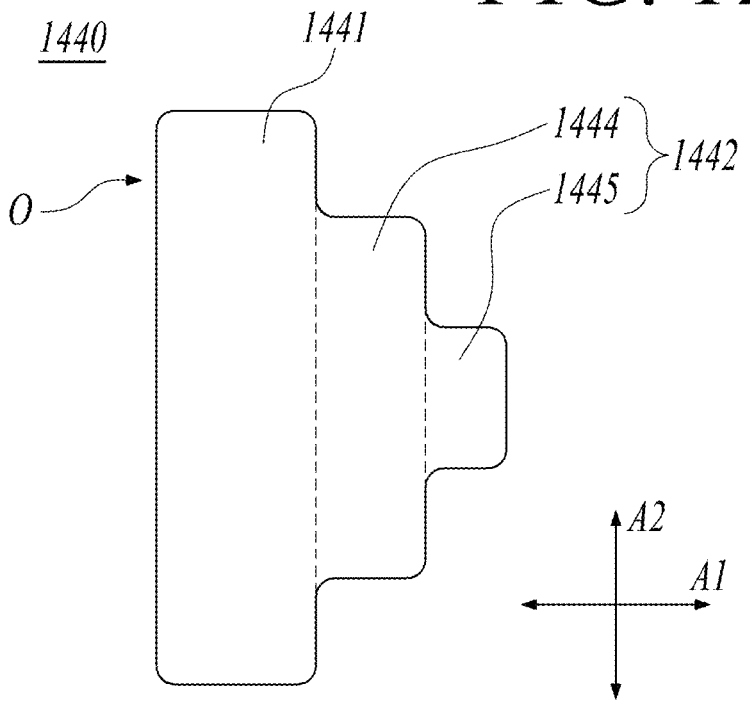
FIG. 12 is a view illustrating an outlet of one cooling hole according to another exemplary embodiment.

FIG. 12 is a view illustrating an outlet of one cooling hole of each turbine blade according to another exemplary embodiment.

Referring to FIG. 12, the cooling hole 1440 may include an expanded portion 1441 and a grooved portion 1442 including a first grooved portion 1444 and a second grooved portion 1445.

When the grooved portion 1442 includes the first and second grooved portions 1444 and 1445, the cooling fluid discharged from the expanded portion 1441 may be guided by the cooling fluid discharged from the first grooved portion 1444. In addition, the cooling fluid discharged from the first grooved portion 1444 may be guided by the cooling fluid discharged from the second grooved portion 1445. That is, the cooling fluids discharged from the expanded portion 1441 and the grooved portion 1442 may interact closely with each other to further maximize cooling efficiency.

Although FIG. 12 illustrates that the grooved portion 1442 of the cooling hole 1440 includes the first grooved portion 1444 and the second grooved portion 1445, it is not limited thereto. For example, recessed nth to n+1th grooved portions may be additionally formed (n is a natural number equal to or greater than 2).

As described above, the turbine blade and the turbine including the same according to the exemplary embodiments may improve cooling efficiency by including the cooling holes each having the expanded portion and the grooved portion.

While one or more exemplary embodiments have been described with reference to the accompanying drawings, it will be apparent to those skilled in the art that various variations and modifications may be made by adding, changing, or removing components without departing from the spirit and scope of the disclosure as defined in the appended claims, and these variations and modifications fall within the spirit and scope of the disclosure as defined in the appended claims. Therefore, the description of the exemplary embodiments should be construed in a descriptive sense and not to limit the scope of the claims, and many alternatives, modifications, and variations will be apparent to those skilled in the art.

What is claimed is:

1. A turbine blade comprising:

an airfoil having a leading edge and a trailing edge formed thereon and a cooling passage defined for flow of a cooling fluid therethrough; and a cooling hole configured to communicate between the cooling passage and outside in the airfoil and having an inlet and an outlet, wherein the cooling hole includes an expanded portion and a grooved portion formed in the outlet, the grooved portion being recessed from the expanded portion toward the trailing edge, wherein, when a direction parallel to a straight line connecting the leading edge and the trailing edge is a first direction, the expanded portion is formed to constantly maintain a 1-1th width, which is a width in the first direction, in at least some sections, wherein the 1-1th width is less than an inner diameter of the inlet.

2. The turbine blade according to claim 1, wherein, when a rotational radial direction of the turbine blade is a second direction, the expanded portion is formed such that a 1-2nd width, which is a width in the second direction, is 4 times or more of an inner diameter of the inlet.

3. The turbine blade according to claim 2, wherein:

the grooved portion is configured such that the width in the second direction is a 2-2nd width; and the 1-2nd width is larger than a sum of the inner diameter of the inlet and the 2-2nd width.

4. The turbine blade according to claim 1, wherein the cooling hole further includes a curved portion having a constant radius of curvature, the curved portion being formed at a boundary between the expanded portion and the grooved portion.

5. The turbine blade according to claim 4, wherein:

when a rotational radial direction of the turbine blade is a second direction, the grooved portion is configured to have a 2-2nd width, which is a width in the second direction;

the curved portion includes two curved portions spaced apart from each other; and a center distance between the two curved portions is larger than the 2-2nd width.

6. The turbine blade according to claim 1, wherein the cooling hole is configured to have a larger cross-sectional area at the outlet than at the inlet.

7. The turbine blade according to claim 1, wherein the expanded portion has a substantially quadrangular shape.

8. The turbine blade according to claim 1, wherein the grooved portion has a substantially quadrangular shape.

9. The turbine blade according to claim 1, wherein:

the grooved portion comprises a first grooved portion and a second grooved portion;

the first grooved portion is recessed from the expanded portion toward the trailing edge; and the second grooved portion is recessed from the first grooved portion toward the trailing edge.

10. A turbine comprising:

a turbine rotor disk configured to be rotatable;

a plurality of turbine blades disposed on the turbine rotor disk; and a plurality of turbine vanes, wherein each of the turbine blades comprises:

an airfoil having a leading edge and a trailing edge formed thereon and a cooling passage defined for flow of a cooling fluid therethrough; and a cooling hole configured to communicate between the cooling passage and outside in the airfoil and having an inlet and an outlet, and wherein the cooling hole includes an expanded portion and a grooved portion formed in the outlet, the grooved portion being recessed from the expanded portion toward the trailing edge, wherein, when a direction parallel to a straight line connecting the leading edge and the trailing edge is a first direction, the expanded portion is formed to constantly maintain a 1-1th width, which is a width in the first direction, in at least some sections, wherein the 1-1th width is less than an inner diameter of the inlet.

11. The turbine according to claim 10, wherein, when a rotational radial direction of the turbine blade is a second direction, the expanded portion is formed such that a 1-2nd width, which is a width in the second direction, is larger than an inner diameter of the inlet.

12. The turbine according to claim 11, wherein:

the grooved portion is configured such that the width in the second direction is a 2-2nd width; and the 1-2nd width is larger than a sum of the inner diameter of the inlet and the 2-2nd width.

13. The turbine according to claim 10, wherein the cooling hole further includes a curved portion having a constant radius of curvature, the curved portion being formed at a boundary between the expanded portion and the grooved portion.

14. The turbine according to claim 13, wherein:

when a rotational radial direction of the turbine blade is a second direction, the grooved portion is configured to have a 2-2nd width, which is a width in the second direction;

the curved portion includes two curved portions spaced apart from each other; and a center distance between the two curved portions is larger than the 2-2nd width.

15. The turbine according to claim 10, wherein the expanded portion has a substantially quadrangular shape.

16. The turbine according to claim 10, wherein the grooved portion has a substantially quadrangular shape.

* * * * *